US008833767B2

(12) United States Patent
Lu

(10) Patent No.: US 8,833,767 B2
(45) Date of Patent: Sep. 16, 2014

(54) DOCUMENT STORAGE DEVICE FOR PRINTER

(71) Applicant: Hon Hai Precision Industry Co., Ltd., New Taipei (TW)

(72) Inventor: Chien-Hao Lu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/892,437

(22) Filed: May 13, 2013

(65) Prior Publication Data

US 2014/0049003 A1 Feb. 20, 2014

(30) Foreign Application Priority Data

Aug. 15, 2012 (TW) ..... 101129585 A

(51) Int. Cl.
*B65H 39/10* (2006.01)
*B65H 29/20* (2006.01)

(52) U.S. Cl.
CPC ..... *B65H 29/20* (2013.01)
USPC ..... 271/302; 271/287; 271/296; 271/303

(58) Field of Classification Search
USPC ..... 271/296, 298, 300, 302, 303, 279, 287, 271/288, 289, 290, 314
See application file for complete search history.

(56) References Cited

U.S. PATENT DOCUMENTS

| | | | | |
|---|---|---|---|---|
| 4,134,581 | A * | 1/1979 | Johnson et al. | 271/288 |
| 4,822,025 | A * | 4/1989 | Chung | 271/296 |
| 4,887,060 | A * | 12/1989 | Kaneko | 399/403 |
| 4,900,009 | A * | 2/1990 | Kitahara et al. | 271/296 |
| 4,913,426 | A * | 4/1990 | Kaneko | 271/296 |
| 5,105,231 | A * | 4/1992 | Watanabe et al. | 399/403 |
| 5,154,411 | A * | 10/1992 | Saito et al. | 271/289 |
| 5,390,910 | A * | 2/1995 | Mandel et al. | 271/296 |
| 7,922,173 | B2 * | 4/2011 | Stapfer | 271/272 |
| 8,146,918 | B2 * | 4/2012 | Shih et al. | 271/279 |
| 8,302,964 | B2 * | 11/2012 | Obuchi et al. | 271/302 |

FOREIGN PATENT DOCUMENTS

JP 06048635 A * 2/1994

* cited by examiner

*Primary Examiner* — Ernesto Suarez
(74) *Attorney, Agent, or Firm* — Novak Druce Connolly Bove + Quigg LLP

(57) ABSTRACT

A document storage device includes a document storage rack, a document distributing apparatus, and a transmitting roller. The document storage rack defines a first storage space and a second storage space. A first protecting door is mounted on the document storage rack to close and lock the first storage space. The second storage space is readily accessible. The document distributing apparatus includes a controlling pole and a first distributing roller connected to the controlling pole. The transmitting roller transmits a document to the first distributing roller. The controlling pole moves the first distributing roller between a first position and a second position. In the first position, the first distributing roller transmits the document into the first storage space. In the second position, the first distributing roller transmits the document into the second storage space.

12 Claims, 5 Drawing Sheets

DOCUMENT STORAGE DEVICE FOR PRINTER

BACKGROUND

1. Technical Field

The present disclosure relates to printers, and more particularly to a document storage device for a printer.

2. Description of Related Art

Multiple users in an office may be connected to a common printer to print files. The printer may be placed in a public area for the users to fetch the printed document. However, if a confidential document is printed, the confidential document may be retrieved by unauthorized persons.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
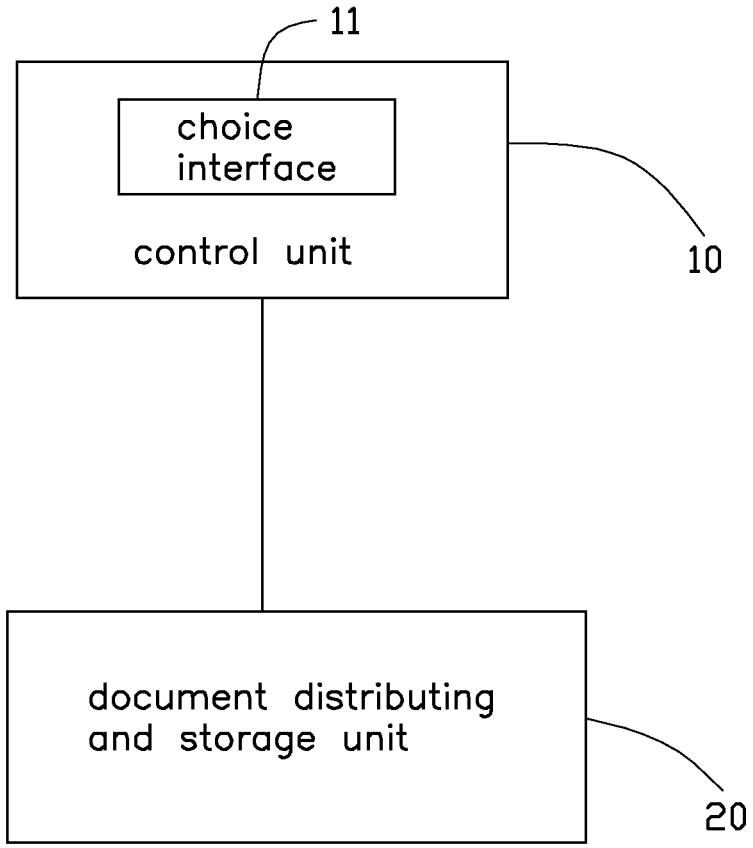
FIG. 1 is a block view of an embodiment of a document storage device for a printer.

Referring to FIG. 1, an embodiment of a document storage device for a printer includes a control unit 10 and a document distributing and storage unit 20. The control unit 10 includes a selection interface 11. The selection interface 11 is used to choose a storage position of printed documents. The control unit 10 controls the document distributing and storage unit 20 to store the printed documents in either one destination, a second destination, or a third destination according to the choice in the selection interface 11.

Figure 2:
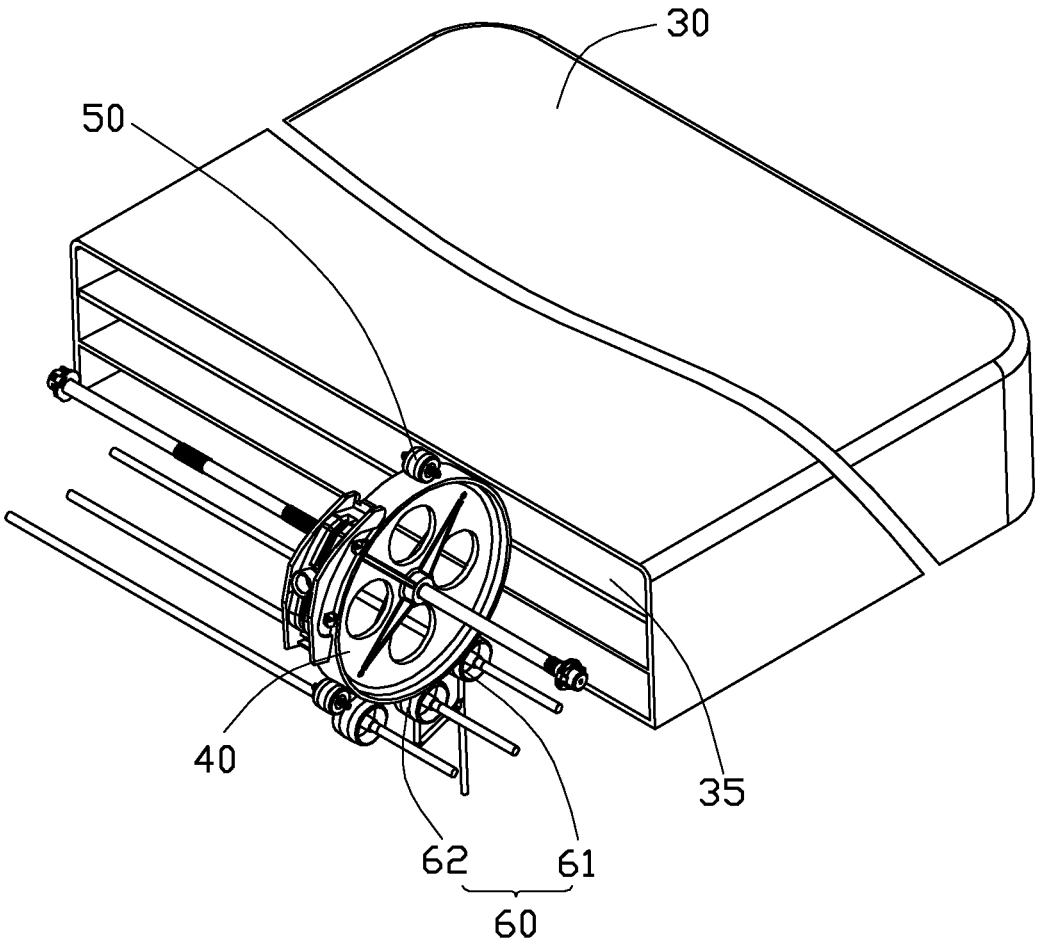
FIG. 2 is an isometric view of the document storage device of FIG. 1.
Figure 3:
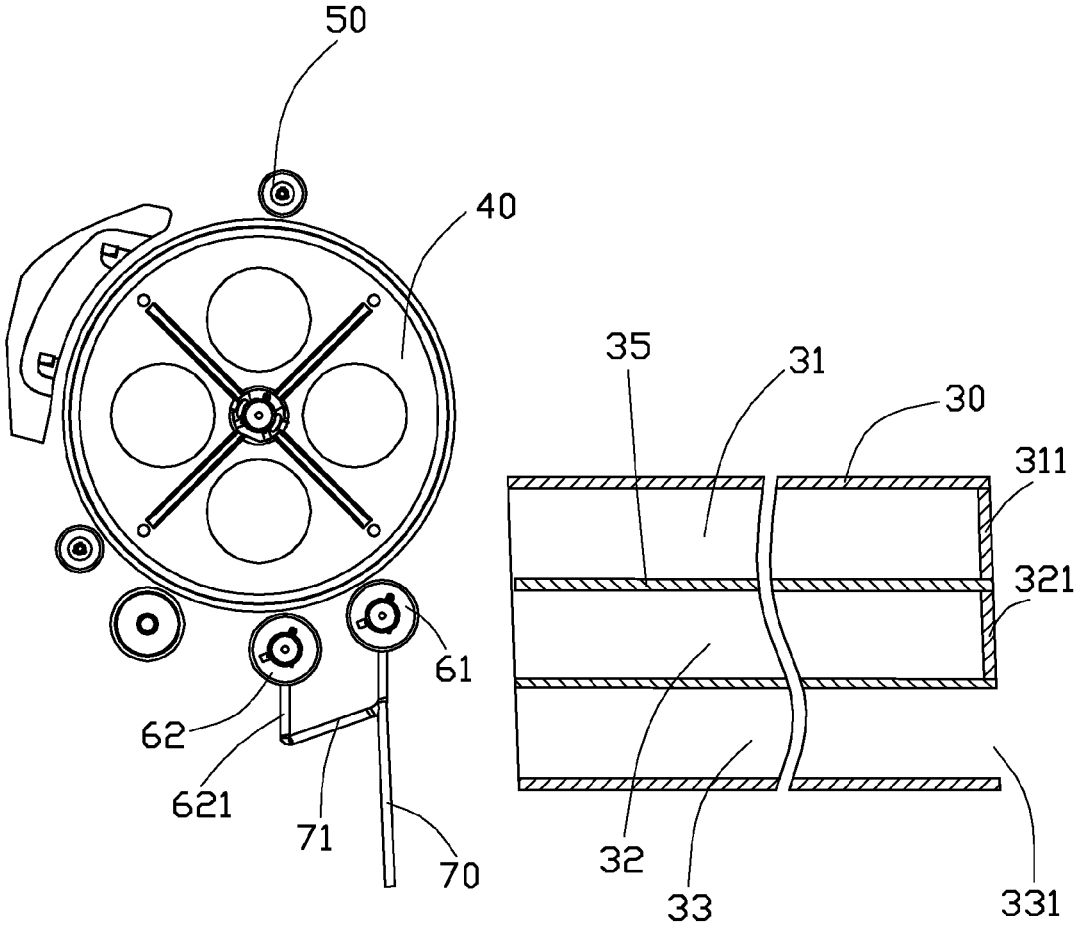
FIG. 3 is a side view of the document storage device of FIG. 2.

Referring to FIGS. 2 and 3, the document distributing and storage unit 20 includes a document storage rack 30, a transmitting roller 40, a plurality of pressing rollers 50, and a document distributing apparatus 60.

An inner room of the document storage rack 30 is divided by a plurality of partition pieces 35. In one embodiment, there are two partition pieces 35 to divide the inner room of the document storage rack 30 into three storage spaces: a first storage space 31, a second storage space 32, and a third storage space 33. The first storage space 31 is located above the second storage space 32. The third storage space 33 is located below the second storage space 32. A side of the first storage space 31 is equipped with a first protecting door 311.

The first protecting door 311 protects the first storage space 31 from any unauthorized access. The first protecting door 311 can only be opened by authorized persons to access and retrieve printed documents in the first storage space 31. A side of the second storage space 32 is equipped a second protecting door 321. The second protecting door 321 protects the second storage space 32 from any unauthorized access. The second protecting door 321 can only be opened by persons who are authorized to access and retrieve printed documents in the second storage space 32. A side of the third storage space 33 defines an opening 331 through which the third storage space 33 can be accessed freely, by any persons.

The transmitting roller 40 transmits the printed document to the document storage rack 30. The plurality of pressing rollers 50 are on the periphery of the transmitting roller 40 and keep the front of the printed document moving around the transmitting roller 40 as it rotates.

The document distributing apparatus 60 is located between the transmitting roller 40 and the document storage rack 30 and is aligned to the document storage rack 30. The document distributing apparatus 60 includes a first distributing roller 61 and a second distributing roller 62. The first distributing roller 61 is connected to a controlling pole 70. The second distributing roller 62 is connected to a stationary pole 621. One end of a connection pole 71 is pivotally connected on a middle portion of the controlling pole 70. Another end of the connection pole 71 is pivotally connected to a bottom end of the stationary pole 621. The controlling pole 70 can be controlled by the control unit 10 to move up and down. Therefore, the first distributing roller 61 moves together with the controlling pole 70 among a first position, a second position, and a third position. At the first position, the first distributing roller 61 is aligned along a tangential line from the transmitting roller 40 to the first storage space 31, to distribute the printed document to the first storage space 31. At the second position, the first distributing roller 61 is aligned along a tangential line from the transmitting roller 40 to the second storage space 32, to distribute the printed document to the second storage space 32. At the third position, the first distributing roller 61 is aligned along a tangential line from the transmitting roller 40 to the third storage space 33, to distribute the printed document to the third storage space 33.

Figure 4:
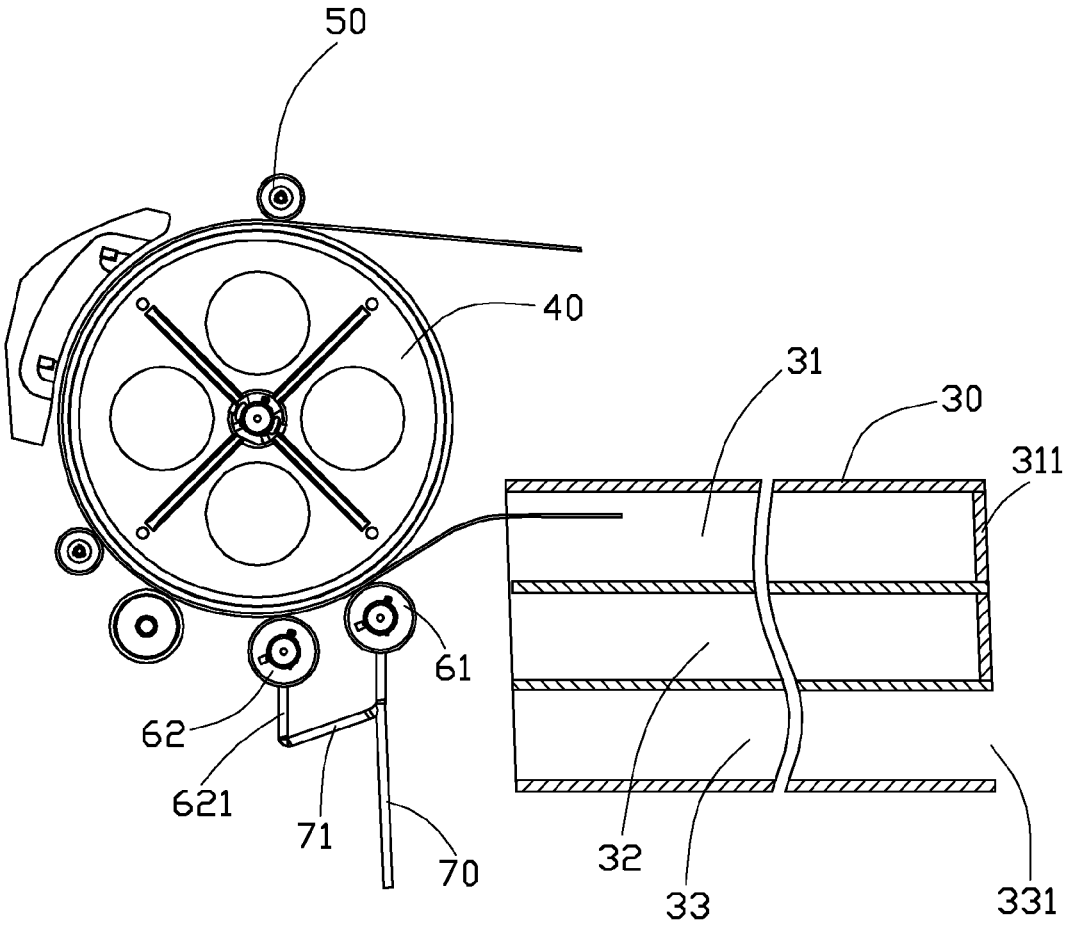
FIG. 4 is another side view of the document storage device of FIG. 2, showing a printed document stored in a first position.
Figure 5:
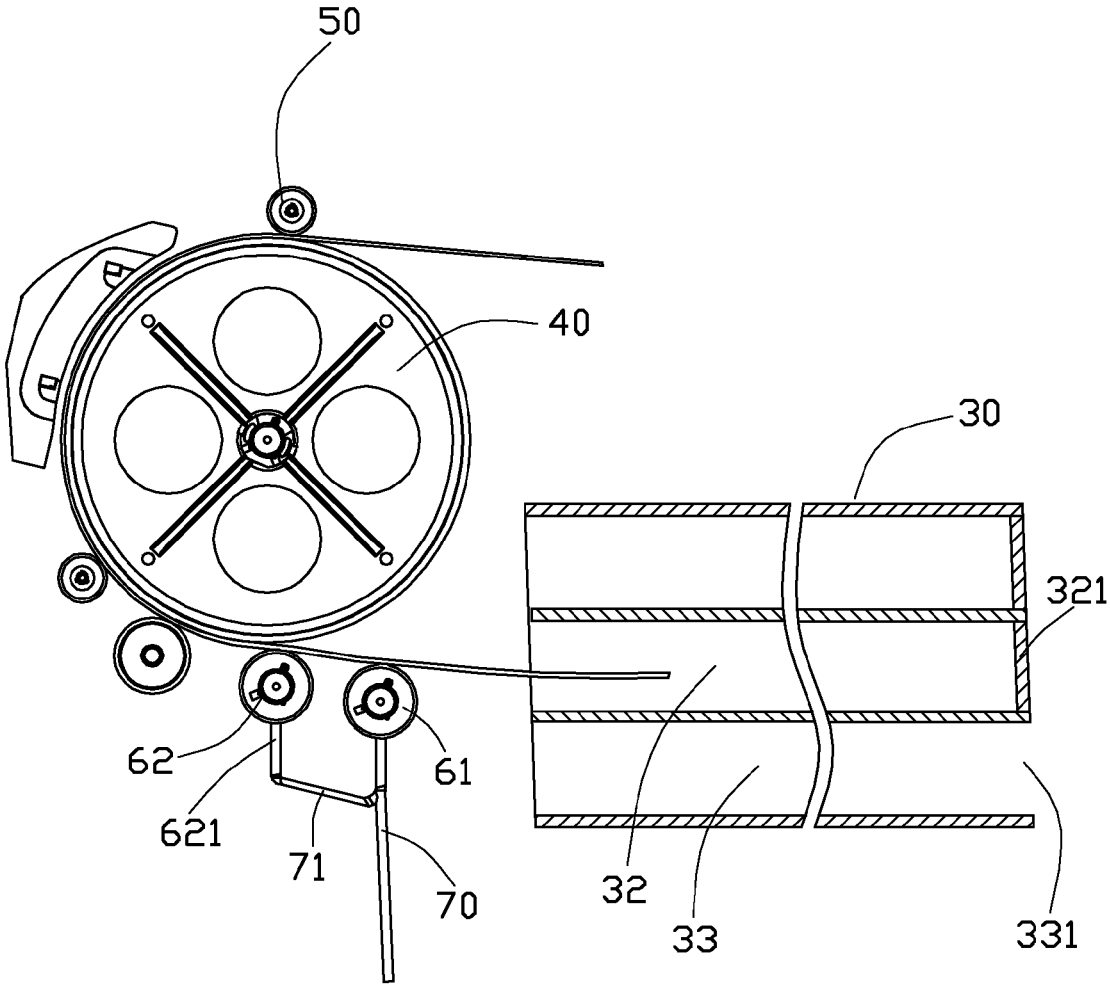
FIG. 5 is another side view of the document storage device of FIG. 2, showing a document stored in a second position.

Referring to FIGS. 4 and 5, in work, the printed document is transmitted to the transmitting roller 40 and the plurality of pressing rollers 50. The transmitting roller 40 rotates to bring the front of the printed document around to the second distributing roller 62 and the first distributing roller 61.

When the first distributing roller 61 is located at the first position, the first distributing roller 61 distributes the printed document in the first storage space 31. If an authorized user needs to pick the printed document from the first storage space 31, such authorized user can open the first protecting door 311 by a first key or a first password to fetch the printed document.

When the first distributing roller 61 is located at the second position, the first distributing roller 61 distributes the printed document in the second storage space 32. If an authorized user needs to pick the printed document from the second storage space 32, such an authorized user can open the second protecting door 321 by a second key or a second password to fetch the printed document.

When the first distributing roller 61 is located at the third position, the first distributing roller 61 distributes the printed document in the third storage space 33. The printed document can be accessed by any person without a key or password.

The document storage device can store the printed document in the first storage space 31, or in the second storage space 32, or in the third storage space 33 according to a user's choice in the selection interface 11.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A document storage device, comprising:

a document storage rack defines a first storage space and a second storage space, a first protecting door mounted on the document storage rack, the first protecting door being configured to close and lock the first storage space, and the second storage space being readily accessible;

a document distributing apparatus comprising a controlling pole and a first distributing roller, the controlling pole being connected to the first distributing roller; and a transmitting roller configured to transmitting a document to the first distributing roller;

wherein the controlling pole is configured to move the first distributing roller between a first position and a second position; in the first position, the first distributing roller is aligned to the first storage space and configured to transmit the document into the first storage space; in the second position, the first distributing roller is aligned to the second storage space and configured to transmit the document into the second storage space; the document distributing apparatus further comprises a second distributing roller, the second distributing roller is connected to a stationary pole, one end of a connection pole is pivotally connected on a middle portion of the controlling pole, and another end of the connection pole is pivotally connected to a bottom end of the stationary pole.

2. The document storage device of claim 1, wherein a plurality of pressing rollers is located on a peripheral of the transmitting roller, and the plurality of pressing rollers is configured to keep the document moving along a rotational direction of the transmitting roller.

3. The document storage device of claim 2, wherein a side of the second storage space defines an opening through which the second storage space can be accessed.

4. The document storage device of claim 1, wherein the first protecting door is configured to be opened by a key or password.

5. The document storage device of claim 1, further comprising a control unit, wherein the control unit controls movements of the controlling pole.

6. The document storage device of claim 5, wherein the control unit comprises a selection interface, the selection interface is configured to choose a storage position of the printed document, and the control unit is configured to control the movements of the controlling pole according to a choice of the selection interface.

7. The document storage device of claim 1, wherein an inner room of the document storage rack is partitioned by a partition piece to form the first storage space and the second storage space.

8. A document storage device, comprising:

a transmitting roller configured to transmitting a document;

a document distributing apparatus comprising a first distributing roller, the first distributing roller being configured to receive the document transmitted from the transmitting roller;

a document storage rack comprising an outside enclosed space and an open space;

a control unit;

wherein the first distributing roller is configured to move between a first position and a second position, in the first position, the first distributing roller is aligned to the outside enclosed space and configured to transmit the document into the outside enclosed space; in the second position, the first distributing roller is aligned to the open space and configured to transmit the document into the open space, the outside enclosed space can be locked and the open space is readily accessible; a controlling pole is connected to the first distributing roller, the control unit is configured to control movements of the controlling pole, and the controlling pole is configured to move the first distributing roller together with the controlling pole, the document distributing apparatus further comprises a second distributing roller, the second distributing roller is connected to a stationary pole, one end of a connection pole is pivotally connected on a middle portion of the controlling pole, and another end of the connection pole is pivotally connected to a bottom end of the stationary pole.

9. The document storage device of claim 8, wherein a plurality of pressing rollers is located on a peripheral of the transmitting roller, and the plurality of pressing rollers is configured to keep the document moving along a rotational direction of the transmitting roller.

10. The document storage device of claim 8, wherein a first protecting door is mounted on the document storage rack, the first protecting door is configured to close the outside enclosed space.

11. The document storage device of claim 10, wherein the first protecting door is configured to be opened by a key or password.

12. The document storage device of claim 8, wherein the control unit comprises a selection interface, the selection interface is configured to choose a storage position of the document, and the control unit is configured to control the movements of the controlling pole according to a choice of the selection interface.

* * * * *